United States Patent [19]

Oudt

[11] Patent Number: 5,036,555

[45] Date of Patent: Aug. 6, 1991

[54] BATHING UNIT WITH ADJUSTABLE HEIGHT PLATFORM

[76] Inventor: Richard J. Oudt, 42 Cedarwood Dr., Ballston Lake, N.Y. 12019

[21] Appl. No.: 535,781

[22] Filed: Jun. 11, 1990

[51] Int. Cl.[5] ..... A47K 3/12

[52] U.S. Cl. ..... 4/495; 4/565; 248/575; 248/601

[58] Field of Search ..... 4/489, 494, 495, 496, 4/505, 560, 564, 565, 566, 571, 573, 578, 579, 580, 585; 248/162.1, 575, 578, 601, 622

[56] References Cited

U.S. PATENT DOCUMENTS

| | | | |
|---|---|---|---|
| 1,024,329 | 4/1912 | Grow | 4/565 |
| 1,175,491 | 3/1916 | Wald | 4/579 X |
| 2,133,587 | 10/1938 | Stark | 4/566 |
| 2,373,694 | 4/1945 | Lentz | 248/601 X |
| 2,540,525 | 2/1951 | Howarth et al. | 248/578 |
| 2,672,915 | 3/1954 | Jones | 248/601 X |
| 2,893,470 | 7/1959 | Peller | 248/575 X |
| 3,346,885 | 10/1967 | Merriman | 4/566 |
| 3,435,466 | 4/1969 | Cheney | 4/566 |
| 3,581,316 | 6/1971 | Petersen | 4/566 |
| 3,882,553 | 5/1975 | Poiencot | 4/565 |
| 3,912,248 | 10/1975 | Pickford et al. | 248/575 X |
| 4,028,751 | 6/1977 | Moran | 4/565 |
| 4,106,134 | 8/1978 | Schiron et al. | 4/495 |
| 4,221,009 | 9/1980 | Wright | 4/566 |
| 4,254,517 | 3/1981 | Herman, Jr. | 4/571 |
| 4,419,776 | 12/1983 | Schmidt | 4/564 |

FOREIGN PATENT DOCUMENTS

| | | | |
|---|---|---|---|
| 593423 | 2/1934 | Fed. Rep. of Germany | 248/601 |
| 1035959 | 9/1953 | France | 4/563 |
| 279496 | 11/1930 | Italy | 248/578 |
| 1370610 | 10/1974 | United Kingdom | 4/565 |
| 2156210 | 10/1985 | United Kingdom | 4/571 |

*Primary Examiner*—Henry J. Recla
*Assistant Examiner*—Robert M. Fetsuga
*Attorney, Agent, or Firm*—Schmeiser, Morelle & Watts

[57] ABSTRACT

A bathing unit which includes a vertically adjustable bottom portion and fluid receiving channels. The lift mechanism includes a spring and manual spring tension adjuster. The user is able to adjust the spring so that the platform moves when the weight of the user plus the weight of the water in the channels is greater or less than the preset spring force.

6 Claims, 2 Drawing Sheets

BATHING UNIT WITH ADJUSTABLE HEIGHT PLATFORM

Field of the Invention

The invention is in the field of bathing units. More specifically, the invention is in the field of bathing enclosures which include modifications to facilitate entry or exit therefrom.

BACKGROUND OF THE INVENTION

Most people can get into or out of a bathtub with little difficulty. However, for a person that is physically handicapped or of advanced age, entry or exit from a bathtub can be very difficult. Furthermore, the smooth tub surface provides few handholds and can become quite slippery when it is wet. Therefore, current tub designs do not provide the safety or convenience that is required by many people.

A number of bathtub modifications and devices are available to help alleviate the above noted problems and difficulties. The most simple of these is the addition of handrails to the sides of the tub and the adjacent walls. This however, does not adequately help those individuals whose arms are somewhat weak due to advanced age or to some handicap.

A number of prior art inventions have been made in the field of movable tub platforms. These platforms either comprise the tub bottom or rest atop the tub bottom and function to temporarily reduce the height difference between the top of the tub's walls and the tub's bottom. Basically, the prior art movable tub platforms are modified commercial type lifts which the user controls with a manual switch. These devices require an external electric or hydraulic power source and can be quite complicated to install, operate or maintain. They operate in a manner which is completely independent of the tub conditions and therefore do not take advantage of the user's weight or the weight of any water within the tub.

SUMMARY OF THE INVENTION

The invention is an improved bathtub device that enables a user to easily enter or exit a bathtub. The instant invention makes use of a vertically adjustable platform that is located on the bottom of the tub. A spring is provided below the platform in order to support the platform and control its vertical position.

Attached to the platform are a number of flexible channels that can receive water when the tub is being filled. The water in these channels is also supported by the spring.

Initially, the platform would be in its raised position. The tub would then be at least partially filled with water until the water completely surrounds the raised platform and fills the channels. The user would then manually adjust the tension in the support spring to a predetermined amount by use of a remote actuator located on the side of the tub. Once the spring tension is properly adjusted, the platform will be almost able to support the weight of the user plus the weight of the water within the channels. The user would then step onto and sit down on the platform. The combined weight of the user plus the water in the channels overcomes the upward spring force and causes the platform to slowly descend. The user would then bathe in the normal manner.

When the user is ready to exit from the tub, he or she would let the water out of the tub. The reduced weight on the spring due to the water draining from the channels allows the spring to raise the platform back to its initial position. At this point, the user would simply slide off the raised platform and step onto the floor. Any remaining water in the tub would flow through the channels and pass to the drain.

DETAILED DESCRIPTIOON OF THE INVENTION

The instant invention is an improved bathing unit for the physically impaired. It comprises a basic bathtub unit in which the bottom of the tub is vertically adjustable to facilitate the entry to or exit from the tub.

Figure 1:
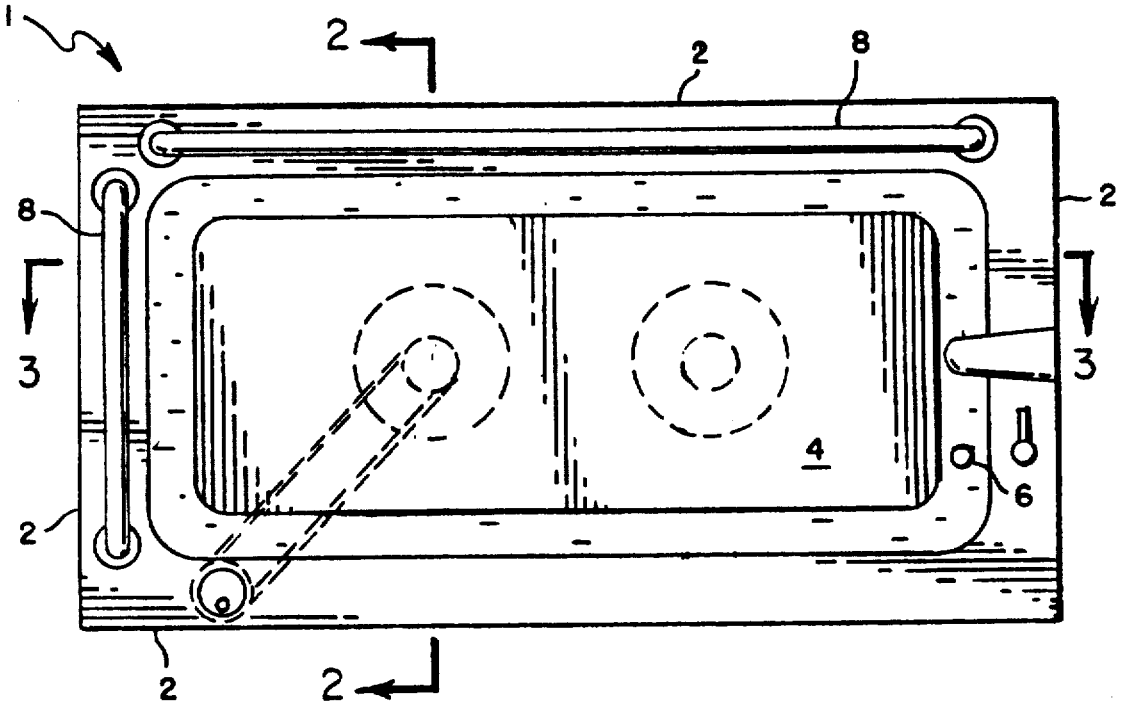
FIG. 1 is a plan view of a bathtub that incorporates the invention.

FIG. 1 is a plan view of the bathing unit 1. The unit is rectangular in shape and comprises four sides 2 and a vertically adjustable bottom platform 4. Forward of the platform is a drain 6 which is used to drain the water from the tub. In this view, a number of handrails 8 can also be seen.

Figure 2:
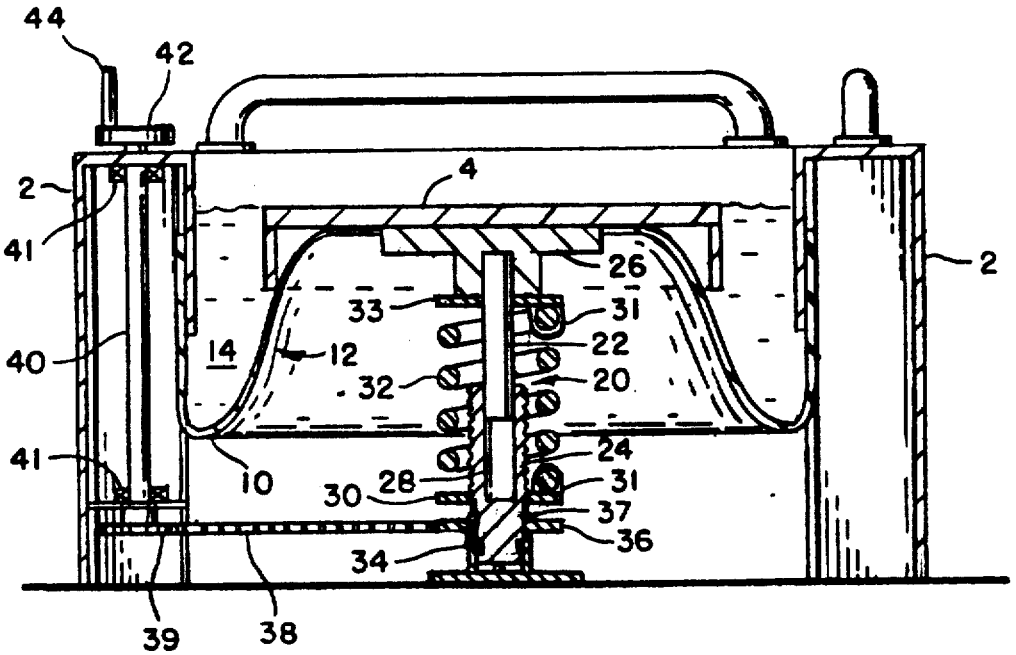
FIG. 2 is a cross-sectional end view of the tub of FIG. 1.

FIG. 2 is a cross-sectional end view of the invention shown in FIG. 1. In this view can be seen the vertically adjustable platform 4 and its support structure.

Connecting the movable platform 4 to the sides 2 is a quantity of flexible, watertight material 10. This material forms a "U"-shaped fluid receiving pocket 12 around the perimeter of the platform. A quantity of water 14 is shown within the flexible pocket.

The movable platform rests atop a spring biased telescoping rod-like member 20. The member includes a top portion 22 and a bottom portion 24. A support flange 26 is located on the top end of the top portion 22 and is used to distribute the support forces onto the underside of the platform. The bottom end of the top portion 22 is slidably received within an elongated cylindrical cavity 28 within the bottom portion 24.

The exterior surface of the bottom portion 24 is threaded and threadedly engages the internal threads of a follower member 30. Fixed to the top of the follower member by a clamp 31 is a spring 32 which extends upwardly to the support flange. The top end of the spring is fixed by another clamp 31 to the underside of a keeper 33 which is immovably attached to the support flange 26.

The bottom end of the telescoping member's bottom portion 24 is rotatably mounted in a bearing member 34. Located proximate and slightly above the bearing member is a gear 36 which is fixed to the bottom member by spotwelds 37. The welds immovably fix the gear to the bottom portion 24 so that any rotation of the gear causes the bottom portion 24 to also rotate.

The gear 36 is connected by a chain 38 to a second gear 39 located at the base of a shaft 40. The shaft is located within one of the sides 2 and it is rotatably mounted by bearings 41 at its top and bottom.

The top end of the shaft 40 has a perpendicularly extending circular handle 42 mounted thereon. The handle has a vertically extending grip member 44 located on its perimeter.

Figure 3:
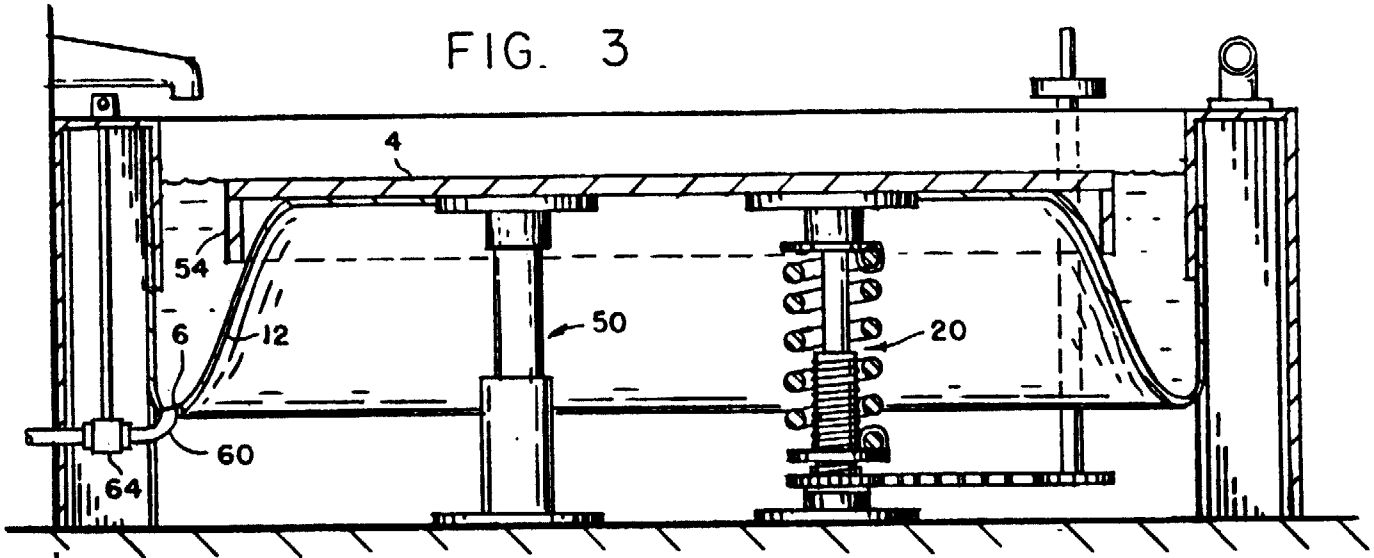
FIG. 3 is a cross-sectional front view of the tub of FIG. 1.

FIG. 3 is a side cross-sectional view of the bathing unit pictured in FIG. 1. In this view can be seen the telescoping member 20 that is shown in FIG. 2 and a second telescoping member 50. The latter member serves a stabilizing function and, in conjunction with the first telescoping member, prevents side-to-side or rotational movement of the platform 4. The tops of these members are shown in phantom in FIG. 1. It should be noted that a spring member is not required on both telescoping members due to their location. The members are located with the spring assisted member being located approximately two-thirds of the longitudinal tub length from the front end 54 of the platform. The second telescoping member is located approximately one-third the longitudinal tub length from the front end of the platform. The spacing of the telescoping members is based on the idea that a user will get into a tub with a major portion of his or her weight located approximately two-thirds of the tub length away from the tub's front end. Therefore, only one spring assisted telescoping member is required. It should be noted that a single, spring assisted telescoping support member can be used in lieu of the two telescoping members. It would be placed approximately in the center of the platform.

Also in FIG. 3, the fluid receiving channel or gutter 12 can again be seen. A flexible hose 60 is shown for connecting the channel drain 6 to the main drain/valve connection 64.

Figure 4:
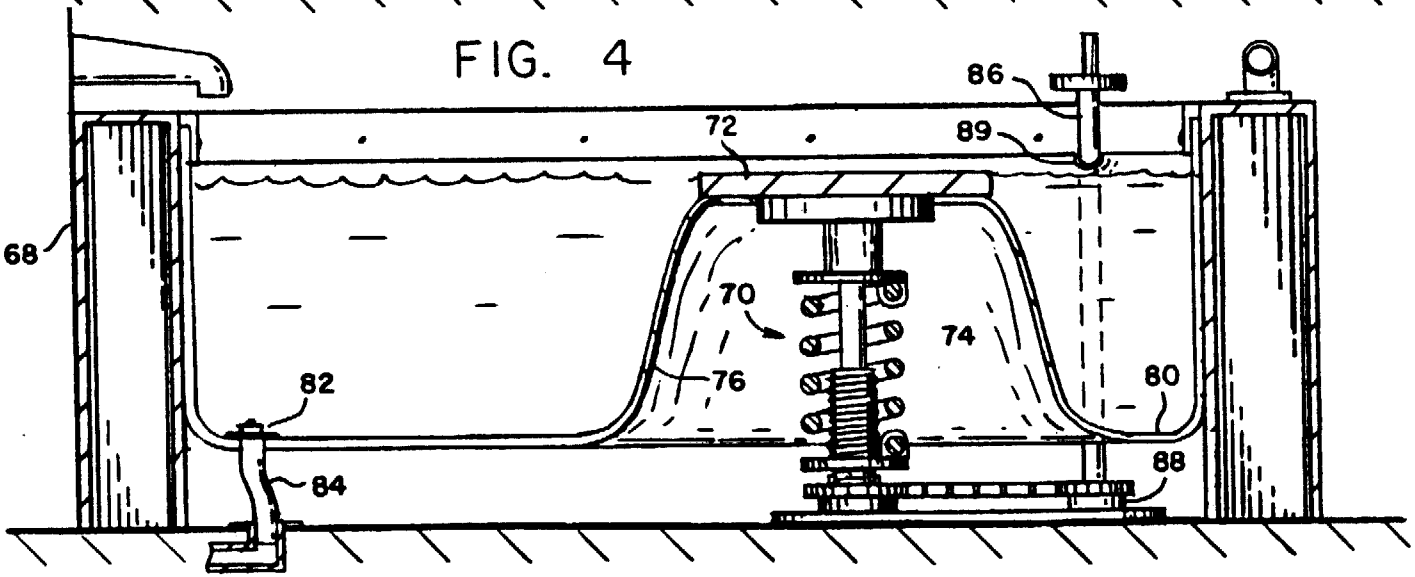
FIG. 4 is a cross-sectional front view of a second embodiment of the invention.

FIG. 4 is a longitudinal cross-section of a second embodiment of the invention. In this embodiment, the invention is added to a conventional tub 68. The spring-assisted telescoping support member and adjustment apparatus shown in FIG. 2 is again used and generally numbered 70. However, in this embodiment, a front telescoping member is not used. Also, only a portion of the tub's bottom is vertically adjustable.

Seat-like platform 72 rests atop the spring assisted telescoping member 74. Surrounding the seat is a flexible waterproof material 76 which is attached to all four sides of the tub. The front portion of the flexible material is sealingly attached to the tub's front wall below the spout. The side, front and rear portions of the flexible material form liquid receiving channels 80. The channel drain 82 is connected by a flexible hose to the tub's drain 84. The actuator shaft 86 passes through a watertight opening 89 in the sidewall of the flexible material. The bottom of the shaft is supported by a base member 88 which is rigidly connected to the support base of the telescoping member. In effect, the second embodiment is a vertically adjustable seat that forms the rear portion of the tub's bottom surface.

In the operation of the primary embodiment, one would start with the platform in its raised position. Next, the adjustment handle 44 would be turned a predetermined amount until the spring tension will support a desired weight. This weight would be of an amount slightly less than the user's own weight plus the weight of the water that will fill the channels 12. By thus doing, the operator would be moving the spring follower so that it would compress the spring so that a force greater than the user's weight on the platform would be required to further compress the spring.

Once the spring force is adjusted, the user would fill the tub with water. Since the platform is in a raised position, the water would basically just fill the "U"-shaped channels. Optionally, the topmost water level can be such that the top of the platform is also immersed.

The user would then slide himself or herself onto the platform. The weight of the user plus the weight of the water within the channels would overcome the preset spring force. This would cause the platform to sink down to a predetermined level. If necessary, the user can further adjust the spring force to cause the platform to sink to a lower position.

When the user is ready to leave the tub, he or she would open the drain and allow the water to drain from the tub. Due to the decreased weight upon the spring, the platform would rise back to its upper raised position. If necessary, the user can further adjust the spring tension to obtain the raised position. If the user did not wish to wait for the water to drain, he or she could adjust the spring tension while the tub is still full of water to thereby quickly raise the platform.

The second embodiment functions in the same manner as the first embodiment. The major difference being that the second embodiment employs a much smaller platform and is capable of being installed in an existing bathtub.

It should be noted that there are a number of modifications that can be made to the basic unit without departing from the object of the invention. Any number of telescoping units may be used. A telescoping unit at each corner of the movable platform will provide a maximum of stability More than one telescoping unit may be spring assisted with the adjustment mechanism connected to as many spring followers as required.

In summary, the invention makes use of a platform elevating mechanism in which external power is not required. The platform lift is adjusted to make use of the weight of the water within the tub in addition to the weight of the user. None of the prior art devices recognize that the water within the tub can be used to advantage by the lift mechanism.

The embodiments disclosed herein have been discussed for the purpose of familiarizing the reader with the novel aspects of the invention. Although two preferred embodiments of the invention have been shown and described, many changes, modifications and substitutions may be made by one having ordinary skill in the art without necessarily departing from the spirit and scope of the invention.

I claim:

1. A bathtub defining an enclosure with a vertically adjustable bottom portion, said bathtub comprising:

a platform means which comprises said vertically adjustable bottom portion;

a height adjustment means for vertically moving to said platform means, said height adjustment means including spring means having a first end operatively connected to said platform means and a second end adapted to be disposed on a support surface;

side means comprising a flexible liquid impermeable sheet supported to surround said platform means and being in sealing engagement therewith whereby a liquid may be contained within said side means and above said platform means; and wherein the bias of said spring means can be adjusted by said height adjustment means such that the weight of a person onn said platform means and the weight of liquid in said side means will cause said platform means to be lowered in said bathtub, and the weight of a person alone will cause said platform means to rise.

2. The bathtub of claim 1 wherein said height adjustment comprises a spring adjustment means which is capable of adjusting the force exerted on said platform means by said spring means.

3. The bathtub of claim 2 wherein said spring adjustment means comprises a means for compressing a spring and an operatively connected manual actuator for said compressing means.

4. The bathtub of claim 3 wherein said spring encircles an extendable member having a rotatably mounted externally threaded bottom portion and said means for compressing said spring is a follower member located below and in contact with said spring, said follower member being threadedly engaged to said threaded portion of said extendable member whereby rotation of said follower member in one direction causes said follower to move upwardly and thereby compress said spring.

5. The bathtub of claim 4 wherein said manual actuator comprises a rotatable handle, a downwardly extending shaft attached to said handle and a connecting means connecting said shaft to said threaded portion of said extendable member whereby rotation of said shaft causes a vertical movement of said follower member.

6. The bathtub of claim 5 wherein said connecting means comprises a gear attached to said shaft, a gear fixedly connected to said threaded bottom portion of said extendable member and a chain encircling both gears.

* * * * *